US005096088A

United States Patent [19]

Grossi

[11] Patent Number: 5,096,088

[45] Date of Patent: Mar. 17, 1992

[54] AUTOMATIC DISPENSING DEVICE FOR ARTICLES WITH BLOCKING OF THE LOADING DOOR AND OF THE DELIVERY DOOR

[76] Inventor: Lucio Grossi, Via Sylva, 30, Bergamo, Italy

[21] Appl. No.: 723,430

[22] Filed: Jun. 28, 1991

[30] Foreign Application Priority Data

Jul. 25, 1990 [IT] Italy ..... 21061 A/90

[51] Int. Cl.[5] ..... G07F 11/00

[52] U.S. Cl. ..... 221/12; 221/153; 221/154; 221/195; 221/286; 221/2

[58] Field of Search ..... 221/151, 152, 153, 154, 221/12, 248, 194, 195, 282, 286, 9; 194/350

[56] References Cited

U.S. PATENT DOCUMENTS

| | | | |
|---|---|---|---|
| 4,146,122 | 3/1979 | Harris | 221/154 |
| 4,180,183 | 12/1979 | Muller | 221/194 |
| 4,296,872 | 10/1981 | Mitchell et al. | 221/195 |
| 4,299,334 | 11/1981 | Weatherly | 221/195 |

*Primary Examiner*—H. Grant Skaggs
*Attorney, Agent, or Firm*—Herbert Dubno

[57] ABSTRACT

Automatic dispensing apparatus for articles, comprising an outer casing (1), a sliding door (6) movable vertically on associated slide guides (7) fixed to the outer casing, there being provided below the sliding access door a movable wall (11), equipped along its lower edge with a hinge (12) in engagement with the outer casing (1), equipped with blocking devices (13) with associated drive structure (21, 22), movable between a closure position which interferes with the sliding of the sliding door and an opening position which does not interfere with said door.

5 Claims, 2 Drawing Sheets

Figure 1:
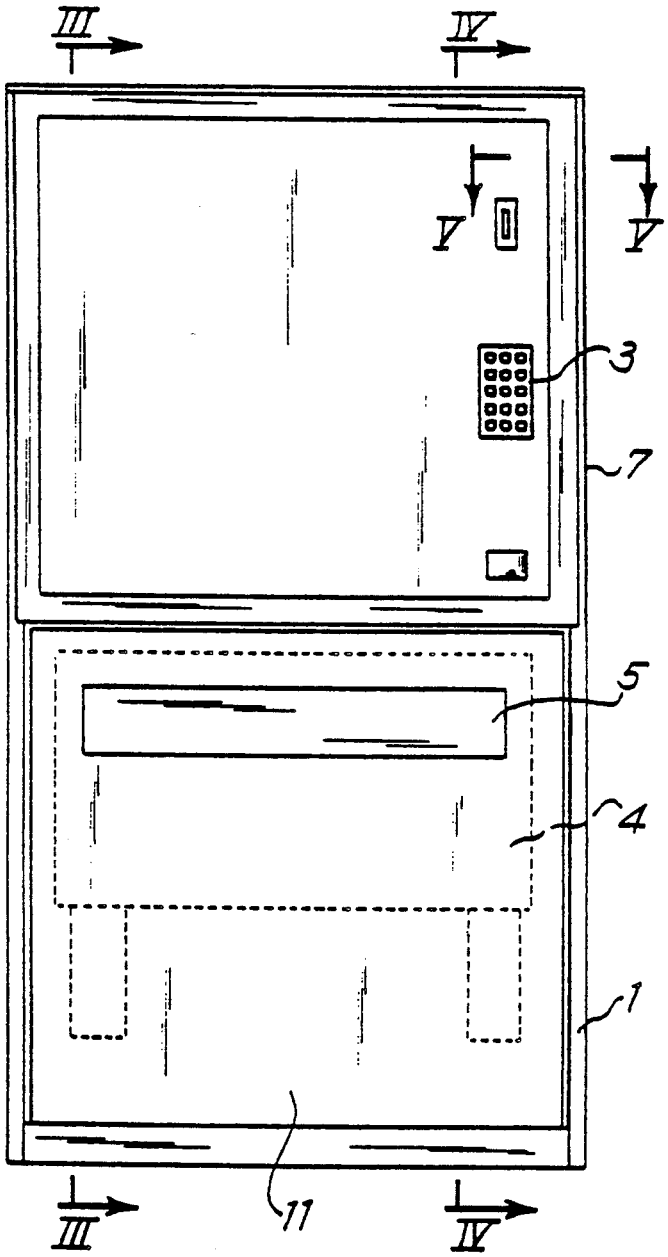

AUTOMATIC DISPENSING DEVICE FOR ARTICLES WITH BLOCKING OF THE LOADING DOOR AND OF THE DELIVERY DOOR

The subject of the present invention is an automatic distributor for articles, of reduced depth and equipped with a delivery door having antitheft security means.

Automatic dispensing devices for articles are widely used, which make possible the obtaining of the article desired after the introduction of a coin or the like into a receiving device.

Such devices must have limited bulk, especially in the direction of their depth, because they are frequently installed in corridors and similar passage locations, in which large bulk would not be acceptable.

Said requirements of compactness of dimensions apply also for loading the articles into the device, because this operation requires the opening of the dispensing device to give access to its interior, and it must be possible to do this without substantially increasing the overall depth of the device.

A further requirement, of primary importance, is represented by the need to be able to prevent thefts and unauthorized interference; automatic dispensing devices are in fact liable to be installed in isolated positions, in locations accessible to the public even during the night, when abuses most commonly take place, and in particular it is possible that an attempt may be made, once access has been gained to the interior of the device for the proper obtaining of an article, to remove further articles without payment of the proper sum, by operating the opening equipment or attempting to gain access to the storage compartments for the articles on sale by introducing a hand or a tool through the dispensing opening.

It is furthermore possible, especially in infrequently visited locations, that attempts will be made to force the openings giving access to the storage compartments, especially by attempting to force hinges or locks of the doors or the like, through which filling of the dispenser is carried out.

The technical problem therefore arises of creating a construction for automatic dispensers of articles, which shall have limited dimensions, especially in the direction of depth, and shall be such as to prevent unauthorized access to its interior, as a result of interference or forcing of its openings, while at the same time allowing easy access to the internal equipment for the standard maintenance operations.

Said results are achieved by the present invention, which provides an automatic dispensing device for articles, constituted of an outer casing, inside which there is present an automatic distributor device associated with relative money collection means, comprising a sliding door movable vertically on associated slide guides fixed to the outer casing, there being present, below the sliding access door, a movable wall equipped with hinge means along its lower edge in engagement with the outer casing, blocking means with related operating means being associated with said wall, these means being movable between a closure position, in correspondence with which the blocking means act in the two opposite directions, blocking the movable wall in a position that interferes with the sliding of the access door to the store of articles, and an open position, in which the movable wall is rotated into a position that does not interfere with the sliding of said access door.

The movable wall is furthermore equipped with a dispensing container, fixed to it and situated below the delivery device, equipped with a pivoting dispensing door open in the movable wall and with a controlled pivoting door for communication with the delivery device, relative interlock means being also present between the dispensing door and the controlled door, these means being adapted for preventing opening of the dispensing door when the controlled door is open.

It is also provided that the blocking means shall comprises a lever pivoted on the dispensing container, having at one end a hook capable of engaging with a corresponding eye fixed to the outer casing, controlled actuating means for the lever being also present, actuating the lever between a position of engagement of the hook with the lever and of the end of the lever with a wall of the outer casing and a position of disengagement of said lever; said actuating means for the lever comprise, in particular, an elastic member interposed between the lever and the container and a connecting rod associated with an operating element, acting on the lever in opposition to the elastic means.

The interlock means between the dispensing door and the controlled door comprise a projection fixed to one of the doors and adapted for coming into contact with the other sad doors when the controlled door is in the open position, and furthermore each slide guide comprises a substantially C-section profile, open towards the access door, in which is slidably contained a profile fixed to said door, the C-section profile being adapted for preventing the insertion of a breaking tool between the access door and the outer casing.

Figure 2:
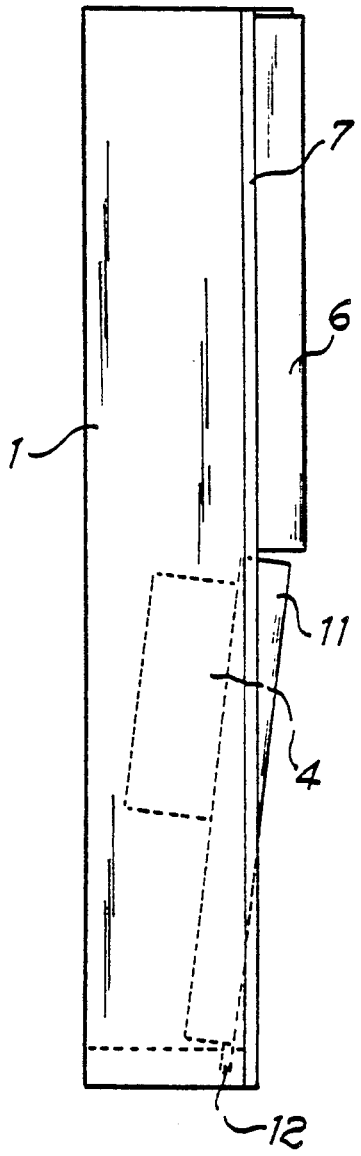
Figure 5:
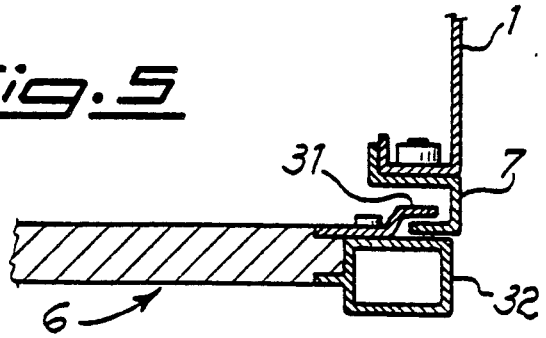
Figure 4:
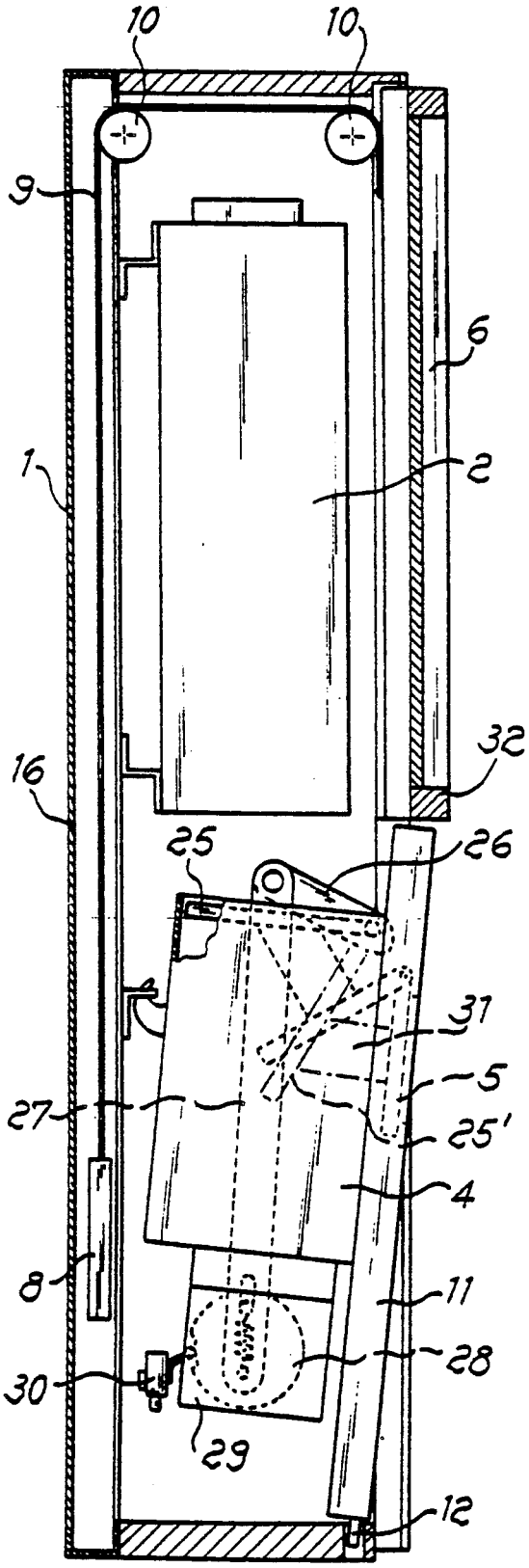
Figure 3:
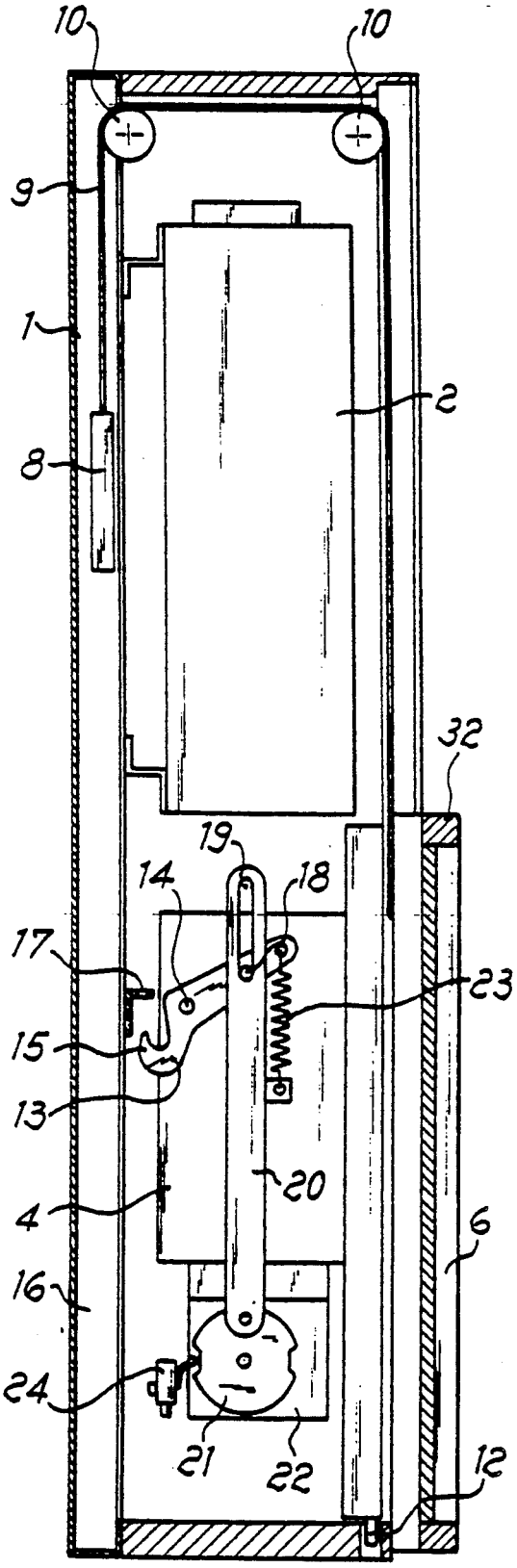

Further details will be understood from the following description of an example of construction of the invention, with reference to the attached drawings, in which there are shown:

in FIG. 1: the distributor according to this invention in front view;

in FIG. 2: the distributor of FIG. 1, seen from the side;

in FIG. 3: a section on the plane III—III of FIG. 1;

in FIG. 4: a said view and a partial section on the plane IV—IV of FIG. 1;

in FIG. 5: an enlarged detail of the slide guide of a door, in section on the plane V—V of FIG. 1.

As FIGS. 1 and 4 show, the distributor according to this invention possesses an outer casing 1, of substantially parallelepipedic shape, adapted to be firmly secured to a fixed structure, such as a wall or the like.

Inside the casing 1 there is a distributor device 2 for articles, itself known and therefore indicated only schematically in the Figure, adapted for containing in a stacked position a certain number of articles for sale and for supplying one of them into a dispensing container 4, situated beneath it, on receipt of a command supplied from a control device 3, activated by a coin or bank note or magnetic card or the like.

The dispensing container 4 is made accessible through a door 5, more clearly visible in FIG. 3, permanently open or capable of being opened only when an article is fed into the dispensing container 4.

The distributor device 2 for articles, itself known and not further described, is accessible from the front through a door 6, slidable in a vertical direction in guides 7, preferably under the counterbalancing action of one or more weights 8, connected to it by cables 9 and associated return pulleys 10, shown in FIGS. 3 and 4.

As shown in FIG. 4, the door 6 can slide downwards to allow free access to the distributor device 2, for refilling and/or maintaining it, without said opening action involving an increase in dimensions in the direction of the depth of the device as a whole.

The door 6 is held in the closure position by the lower movable wall 11, pivoted at the bottom to the casing 1 by articulations 12, composed for example of projecting elements inserted with clearance into respective holes, as shown schematically in the Figure, or with a more complex construction of hinges or the like.

The door 5 opens on the movable wall 11 and the dispensing container 4 is fixed to this same wall.

The movement of the wall 11 is governed by a lever 13, pivoted on a fixed pin 14 to one side of the container 4, which lever has, at one of its ends, a hook 15, capable of engaging with its curved end surface with the rear wall 16 of the outer casing 1.

The engagement of the end surface of the hook 15 with the back wall of the casing 1 pushes the movable wall 11 into a forward position, underneath the door 6, which therefore remains blocked in the raised position; in this rotated position, the hook 15 engages into an eye 17, which prevents further rotation of the lever 13 and of said movable wall 11.

At the end of the lever 13 opposite to the hook 15 with respect to the pin 14, this lever carries a pin 18, movable in an end slot 19 of a connecting rod 20, the opposite end of which is attached to a drive disc 21, rotatably driven by a motor 22.

At the end of the lever 13 remote from the hook 15, there is also present a spring 23, which biases the lever into a position of engagement of the hook 15 with the eye 17, in opposition to the connecting rod 20.

In this manner, a rotation of one half-revolution of the disc 21, from the position shown in FIG. 4, releases the rotation of the lever 13, which can then engage into the eye 17 under the action of the spring 23, while the rotation a further half-revolution, bringing the complex into the position shown in FIG. 4, rotates the lever 13 and disengages the hook 15 from the eye 17, allowing the wall 11 to rotate into the backward position and the door 6 to be lowered.

The angle of rotation of the motor 22 is controlled by a switch 24, actuated by a cam profile or the like formed on the outer surface of said disc 21, or by analogous means.

This arrangement means that the displacement of the door 6 into the open position can be carried out only by actuating the movement of the motor 22, for example by means of a magnetic card or the like, while it makes impossible forced entry, such as could occur with a conventional lock, which can be tampered with, for instance, with a took, drill or the like.

The container 4 has an upper door 25, hinged along one edge adjacent to the wall 11 and the door 5; the upper door 25 is attached to a lever 26, connected by a connecting rod 27 with a drive wheel 28, actuated by a motor 29 controlled by a switch 30.

The rotation of the wheel 28, associated with actuation of the dispensing device 2, causes opening the door 25, as illustrated by the reference 25', and allows the dispensed article to fall into the container 4; a projection 31 comes into contact with the upper door 25 when it is in the open position, and thus prevents opening of the door 5.

If, on the other hand, the door 25 is in he closure position, it becomes possible to open the door 5 and it is therefore possible to take the article present in the container 4, without however the possibility of gaining access to and forcing the door 25.

A slide guide for the door 6 is illustrated in FIG. 5; as can be seen from this Figure, this is a metal profile 7, substantially of C-section, fixed to the casing 1, in which there is guided a profile 31 fixed to the surrounding frame 32 of the door 6.

This construction cooperates with the means for controlling the opening action described above, to prevent forcing open of the equipment: the profile 7, appropriately of metal, in fact protects and prevents access by picklocks and the like to the profile 31, which keeps the door 6 securely engaged to the casing 1.

Another characteristic of the constructional arrangement described above consists in the possibility of complete removal outwards of the movable wall 11 for the purpose of allowing access to the equipment, such as compressors and the like, disposed on the back wall of the distributor behind said movable wall; as will be seen from the Figures, it is in fact possible, once the hook 15 has been disengaged from the eye 17, to rotate the movable wall 11 by hand outwards and forwards until it passes the plane of the sliding door 6, and then to raise it until the pins 12 come out of engagement with their seatings, thus permitting complete removal of the wall.

Numerous constructional variants can be introduced, without thereby departing from the scope of the invention in its general characteristics.

What is claimed is:

1. Automatic dispensing device for articles, comprising an outer casing (1), inside which is disposed a distributor device (2), associated with relative actuation means for the distribution (3), characterized by the fact that it comprises a sliding door (6) for access to the distributor device, movable vertically on associated slide guides (7) fixed to the outer casing, a movable wall (11) being disposed below the sliding access door, this movable wall being equipped, along its lower edge, with hinge means (12) in engagement with the outer casing (1), and equipped with blocking means (13) having associated control means (21, 22) for controlling the movement of the blocking means, said blocking means movable between a closure position, in which the blocking means acts to block the movable wall in a position that interferes with the sliding of the access door, and an opening position, in which the movable wall is allowed to rotate into a position that does not interfere with the sliding of the access door; the movable wall being provided with a dispensing container (4) situated beneath the distributor device (2) and equipped with an associated pivoting dispensing door (5) mounted in the movable wall, the dispensing container also having a controlled pivoting door (25) positional in the path of communication between the interior of the dispensing container and the distributor device (2); and further including interlock means positioned between the dispensing door (5) and the controlled door (25), the interlock means preventing opening the dispensing door (5) when the controlled door is open.

2. Automatic dispensing device for articles according to claim 1, characterized by the fact that said blocking means comprise a lever (13), pivoted to the dispensing container (4), which lever has an end hook (15) capable of engaging into a corresponding eye (17) fixed to the outer casing (1), and controlled actuating means being provided for the lever (13) for actuating it between a position of engagement of the hook (15) with the wall (1) and a position of disengagement of said lever from said wall.

3. Automatic dispensing device for articles according to claim 2, characterized by the fact that said actuating means for the lever (13) comprise an elastic element (23), interposed between the lever (13) and the container (4) and adapted for rotating the lever into a position of engagement of the hook (15) with the wall of the outer casing, and a connecting rod (20) associated with an operating element (21) and acting on the lever in opposition to said elastic means.

4. Automatic dispensing device for articles according to claim 1, characterized by the fact that the interlock means between the dispensing door (5), and the controlled door (25) comprises a projection (31), fixed to one of these doors, for coming into contact with the other of said doors when the controlled door is in the open position.

5. Automatic dispensing device for articles according to claim 1, characterized by the fact that the slide guides each comprise a profile (7) of substantially C-section, open towards the access door, inside which profile is slidably contained a profile (31) fixed to said door, the C-section profile being adapted for preventing the interposition of a breaking tool between the access door and the outer casing.

* * * * *